US009499931B2

(12) United States Patent
Ham et al.

(10) Patent No.: US 9,499,931 B2
(45) Date of Patent: Nov. 22, 2016

(54) FULLY AUTOMATIC WASHING MACHINE HAVING A LAUNDRY LIFTING DEVICE

(71) Applicant: Dongbu Daewoo Electronics Corporation, Seoul (KR)

(72) Inventors: Young Ho Ham, Yongin-si (KR); Young Shin Park, Seoul (KR); Jin Sub Youn, Anyang-si (KR); Ahn Chul Jung, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 88 days.

(21) Appl. No.: 14/132,872

(22) Filed: Dec. 18, 2013

(65) Prior Publication Data

US 2015/0135778 A1 May 21, 2015

(30) Foreign Application Priority Data

Nov. 21, 2013 (KR) ..... 10-2013-0142030

(51) Int. Cl.
*D06F 17/08* (2006.01)
*D06F 17/10* (2006.01)

(52) U.S. Cl.
CPC ..... *D06F 17/08* (2013.01); *D06F 17/10* (2013.01)

(58) Field of Classification Search
CPC ..... D06F 13/06; D06F 13/08; D06F 13/04; D06F 13/02
USPC ..... 38/147
See application file for complete search history.

(56) References Cited

U.S. PATENT DOCUMENTS

| | | | | | |
|---|---|---|---|---|---|
| 2,140,846 | A * | 12/1938 | Molinare | D06F 13/04 | 68/122 |
| 2,172,632 | A * | 9/1939 | Whyte | D06F 13/04 | 68/131 |
| 3,425,559 | A * | 2/1969 | Sisson | D06F 13/04 | 210/138 |
| 6,070,439 | A * | 6/2000 | Jung | D06F 17/10 | 68/134 |
| 2010/0175434 | A1* | 7/2010 | Park | D06F 17/08 | 68/147 |
| 2015/0135778 | A1* | 5/2015 | Ham | D06F 13/02 | 68/133 |

FOREIGN PATENT DOCUMENTS

| | | |
|---|---|---|
| CN | 2072542U U | 3/1991 |
| KR | 20-1996-0022713 | 7/1996 |
| KR | 1019980056390 | 9/1998 |
| KR | 1020100083916 A | 7/2010 |

OTHER PUBLICATIONS

KR 96-22713_translation.*
Korean Office Action dated Mar. 18, 2015 issued in corresponding Korean Patent Application No. 10-2013-0142030.

* cited by examiner

*Primary Examiner* — David Cormier
*Assistant Examiner* — Rita Adhlakha

(57) ABSTRACT

Disclosed is a fully automatic washing machine for easily unloading washed laundry on a bottom surface of a washing tub, and more particularly, to a full automatic washing machine for easily unloading laundry by lifting the laundry from the bottom of the washing tub by lifting a pulsator at the bottom of the washing tub.

18 Claims, 4 Drawing Sheets

FULLY AUTOMATIC WASHING MACHINE HAVING A LAUNDRY LIFTING DEVICE

CROSS-REFERENCE TO RELATED APPLICATIONS

This application is based on and claims priority from Korean Patent Application No. 10-2013-0142030, filed on Nov. 21, 2013, the disclosure of which is incorporated herein in its entirety by reference.

TECHNICAL FIELD

The present disclosure relates to a fully automatic washing machine having a laundry lifting device, such that the washed laundry on or at a bottom surface of a washing tub may be easily removed, and more particularly, to a fully automatic washing machine having a laundry lifting device that is capable of lifting the laundry on or at a bottom of a washing tub using a pulsator that is at the bottom of the washing tub.

BACKGROUND

Generally, a fully automatic washing machine performs several washing cycles, including supplying water to the tub, washing, spin-drying, and draining water from the washed laundry.

As illustrated in FIG. 1, the fully automatic washing machine 10 includes a body 11, a water storage tank 12, a washing tub 13, a pulsator 14, a pulsator shaft 15, a washing tub shaft 16, a clutch assembly 17, a motor (not illustrated), and the like.

The pulsator 14 is connected to the pulsator shaft 15 and configured to rotate. The washing tub 13 is connected to the washing tub shaft 16 and configured to rotate. The clutch assembly 17 regulates a connection between the motor and the pulsator shaft 15 and the washing tub shaft 16, respectively.

A cover is on an upper end of the body 11 and is configured to open for loading the laundry into the washing tub 13. The pulsator 14 rotates in the water storage tank 12, which is supplied with water and a detergent for washing the laundry.

During the spin-drying process, the washing water in the water storage tank 12 is drained, and subsequently the washing tub 13 having a plurality of spin-drying holes in a wall thereof is configured to rotate at a high speed to generate a centrifugal force and spin-dry the laundry.

In general, the conventional washing tub 13 is deep. Therefore, it may be difficult for some persons to reach and unload the washed laundry at the bottom of the tub. In addition, the laundry may still be wet even after the spin-drying process. As a result, it may be difficult for some persons to unload the heavy laundry.

Recently, a large-capacity washing machine that is capable of washing a large amount of laundry in a single load has been widely used. As a result, the size of the washing tub 13 has increased and the problems with regards to unloading the washed laundry becomes more difficult.

SUMMARY

The present disclosure has been made in an effort to provide a fully automatic washing machine having a laundry lifting device that is capable of lifting the laundry on or at a bottom of a washing tub using a pulsator that is at the bottom of the washing tub.

Embodiments of the present disclosure provide a fully automatic washing machine having a laundry lifting device, including a water storage tank in a body; a rotatable washing tub in a water storage tank configured to perform washing and/or spin-drying processes; a rotatable pulsator on or at a bottom surface of the washing tub, configured to generate one or more water streams; a washing tub shaft connected to the washing tub, configured to rotate the washing tub; a control shaft connected to the pulsator, configured to move the pulsator up and down; a pulsator shaft connected to the pulsator, configured to rotate the pulsator; a clutch assembly configured to transfer power from a motor to the washing tub shaft, the control shaft, and the pulsator shaft.

A rotating central portion of the pulsator may be provided with a control guide having a predetermined height. A bottom surface of the pulsator may have a support plate configured to support the pulsator as it ascends and descends (e.g., moves up and down). The central portion of the support plate may have a screw hole in a vertical direction. The washing tub shaft may be below the guide. The control shaft may be threaded through (screwed or connected to) the screw hole of the support plate through a hollow portion of the washing tub shaft. The pulsator shaft may be connected to the pulsator through the hollow portion of the control shaft to move the pulsator and/or the support plate up and down when the control shaft rotates in a direction in which the support plate does not rotate.

An internal portion of the control guide may have an insertion space. The central portion of the support plate may have a protrusion with a predetermined height, configured to be inserted in the insertion space of the guide. The screw hole may be on the protrusion at a predetermined height.

An upper end of the control guide of the pulsator may have a coupling hole that is on the same shaft line or axis as the screw hole. The coupling hole may have a geared or serrated inner surface (e.g., with "teeth"). The upper end of the pulsator shaft may have a coupling gear 171, configured to attach to, mesh with or fit in the coupling hole.

The fully automatic washing machine may further include a fixing hole having a predetermined height around the screw hole of the support plate; and a fixing rod having one end fixed to a support part and another end inserted into the fixing hole of the support plate, configured to prevent the support plate from idling during the ascent and descent of the pulsator.

The support plate may cover the lower or bottom surface of the washing tub to move all the laundry upward.

The outer ends of the support plate and the pulsator may be bent, curved, or angled upward, so that the laundry may be collected in the central portion.

The control shaft moves the pulsator downward at the time of the washing process and/or the spin-drying process, and moves the pulsator upward to assist the process of unloading the laundry after the washing and/or spin-drying process (or washing cycle) is finished.

The pulsator is at or over the lowermost or bottom surface of the washing tub, configured to ascend and descend using the rotation of the control shaft that may serve as a ball screw. Therefore, the washed laundry at the bottom of the washing tub may be mechanically lifted and easily be unloaded.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
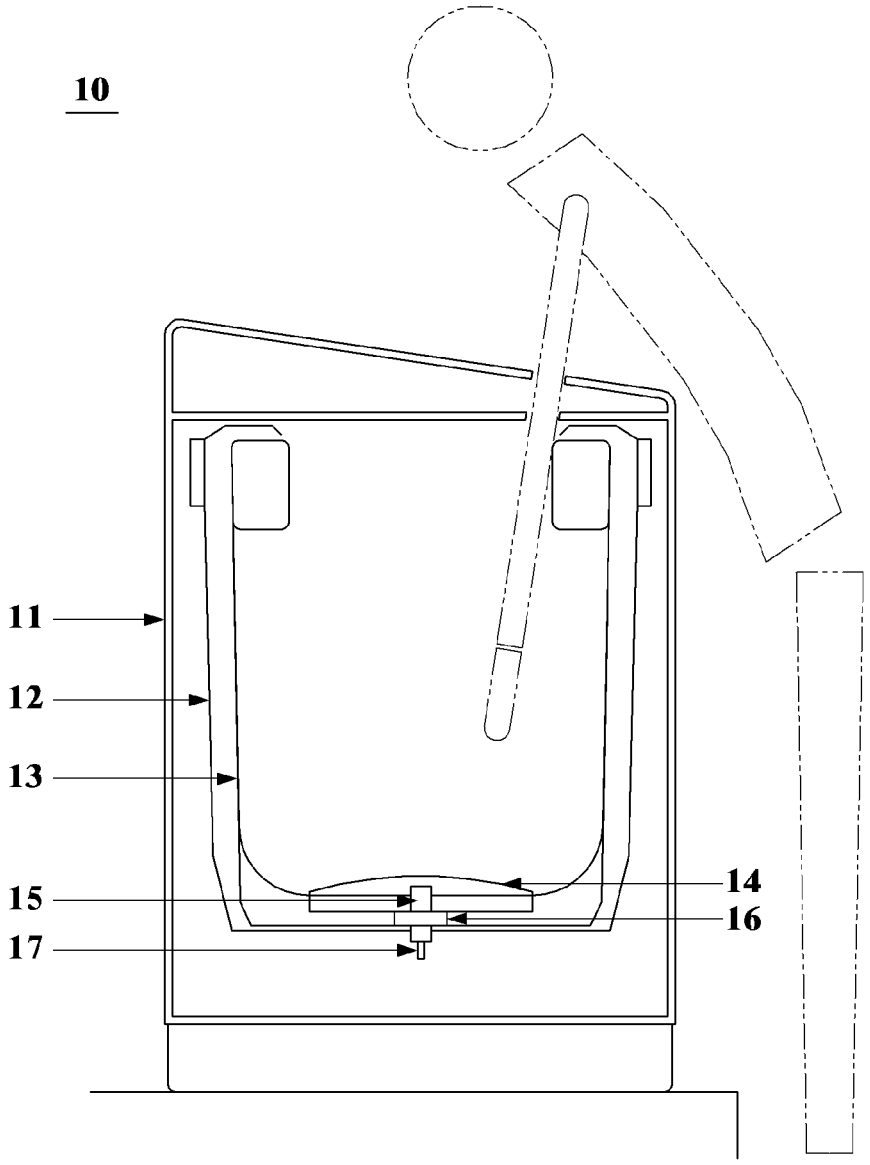
FIG. 1 is a schematic diagram illustrating a fully automatic washing machine according to the related art.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Hereinafter, a fully automatic washing machine having a laundry lifting device according to exemplary embodiments of the present disclosure will be described in detail with reference to the accompanying drawings. As those skilled in the art will realize, the described exemplary embodiments may be modified in various different ways, all without departing from the spirit or scope of the present disclosure, which is not limited to exemplary embodiments described herein. A configuration and an operational effect according to exemplary configurations of the present disclosure will be clearly understood through the detailed description below. Like reference numerals designate like elements throughout the specification. A detailed explanation of known related functions and constitutions may be omitted when the detailed explanation obscures the subject matter of the present disclosure.

It is noted that the drawings are schematic and are not necessarily dimensionally illustrated. Relative sizes and proportions of parts in the drawings may be exaggerated or reduced in their sizes, and a predetermined size is just exemplary and not limiting.

The exemplary embodiments of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form by manufacturing.

Figure 2:
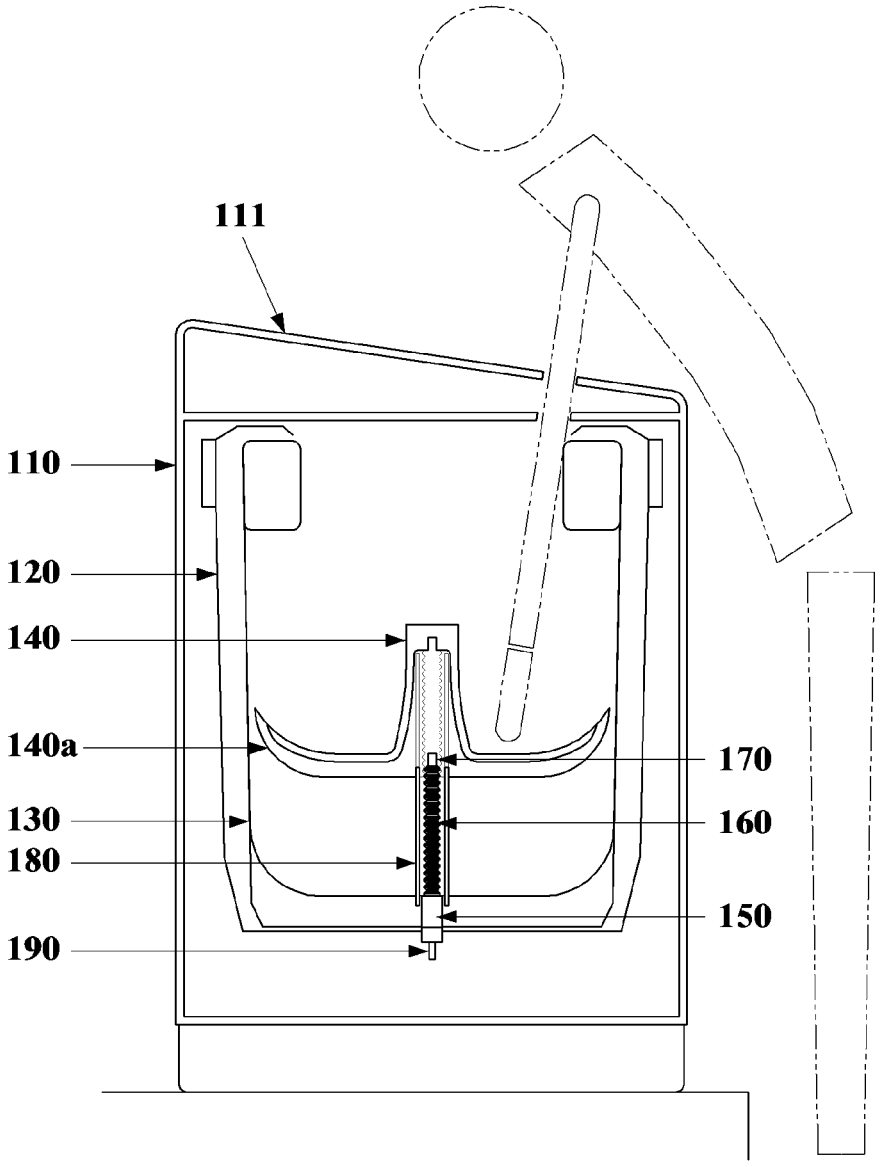
FIG. 2 is a diagram illustrating the fully automatic washing machine having a laundry lifting device according to exemplary embodiments of the present disclosure.

As illustrated in FIG. 2, an exemplary washing machine 100 with a laundry lifting device includes a body 110, a water storage tank 120, a washing tub 130, a pulsator 140, a support plate 140*a*, a washing tub shaft 150, a control shaft 160, a pulsator shaft 170, a fixing rod 180, a clutch assembly 190, and the like. The body 110 is configured to be large enough to contain the water storage tank 120, the washing tub 130, the pulsator 140, the support plate 140*a*, the washing tub shaft 150, the control shaft 160, the pulsator shaft 170, the fixing rod 180, and the clutch assembly 190.

The body 110 has a door 111 on an upper portion thereof and a drainage hole (not illustrated) at one side on or in a lower or bottom portion thereof. The laundry may be loaded into the washing tub 130 when the door 111 is opened and the drainage hole drains the washing water in the water storage tank 120 during the spin-drying process.

The water storage tank 120 may be filled with water during the washing process and may be drained through the drainage hole during the spin-drying process. The washing tub 130 (e.g., a rotatable washing tub) has a plurality of spin-drying holes on or in a wall thereof and is in the water storage tank 120 to perform washing and/or spin-drying processes.

The pulsator 140 (e.g., a rotatable pulsator) is at or over a lower or bottom surface of the washing tub 130 configured to generate a water stream and is connected to the pulsator shaft 170. The washing tub shaft 150 is connected to the washing tub 130, and is configured to rotate the washing tub 130.

Each manufacturer may design, program and/or choose different types of washing methods in different washing machine models. Thus, the washing process may be performed by rotating the pulsator 140, the washing tub 130, or simultaneously rotating the pulsator 140 and the washing tub 130.

The spin-drying process is generally performed by simultaneously rotating the washing tub 130 and the pulsator 140. However, to prevent the laundry from being damaged or tangled, the pulsator 140 may move freely (e.g., be disconnected from the rotating force from the motor), and the washing tub 130 may rotate at a predetermined rate.

The washing machine according to embodiments of the present disclosure further includes the control shaft 160 in addition to the washing tub shaft 150 and the pulsator shaft 170. Furthermore, the exemplary embodiments may utilize a 3-shift clutch assembly 190 instead of a 2-shift clutch assembly according to the related art.

The washing machine includes a first shift and/or gear that regulates the washing tub shaft 150, a second shift and/or gear that regulates the control shaft 160, and a third shift and/or gear that regulates the pulsator shaft 170. The 3-shift clutch is known in the art and therefore in the exemplary embodiments of the present disclosure, any clutch known in the art may be applied.

According to the exemplary configuration, the washing and spin-drying processes may be performed by the washing tub shaft 150 and the pulsator shaft 170, and the power of the motor is applied to each shaft by the clutch assembly 190. Furthermore, the pulsator 140 may ascend and descend by the control shaft 160.

Figure 3:
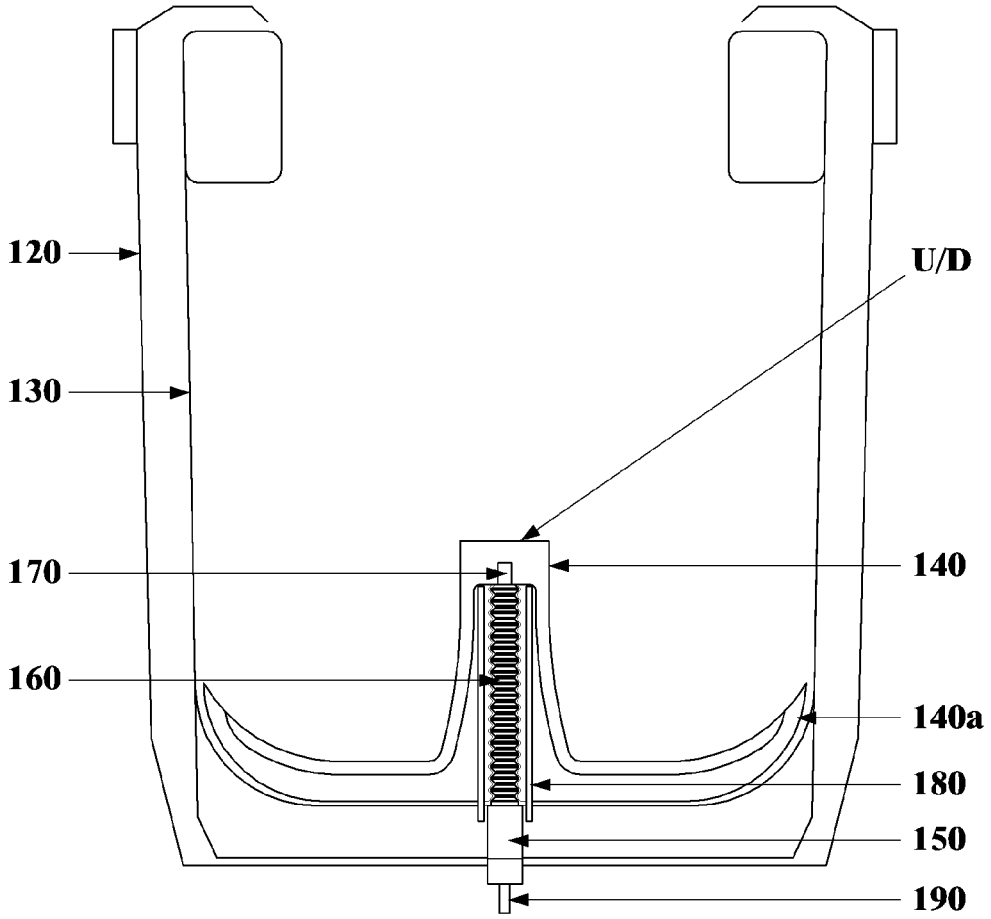
FIG. 3 is a configuration diagram of the fully automatic washing machine having a laundry lifting device according to exemplary embodiments of the present disclosure when the laundry is washed or spin-dried.

As illustrated in FIG. 3, after the washing cycle is finished, the pulsator 140 at the bottom of the washing tub 130 lifts the washed laundry, and thus, a user may easily unload the laundry. Furthermore, during the washing and/or spin-drying processes, the pulsator 140 descends.

According to embodiments of the present disclosure, a method for moving the pulsator 140 up and down by the control shaft 160.

For example, the washing tub shaft 150 and the pulsator shaft 170 are at a rotating central portion or axis of the pulsator 140, and the control shaft 160 is around the pulsator 140 to move the pulsator 140 up and down (e.g., moving vertically upward and downward).

As the control shaft 160, a cylinder rod with an external spiral or screw thread may also be used.

However, when the control shaft 160 is separate from other shafts, a structure of the clutch assembly 190 may be more complicated and may require an additional motor, thereby increasing a price of the washing machine.

Therefore, it is preferable to use a ball screw structure to move the pulsator 140 up and down, where a screw thread is on an outer circumferential surface of the control shaft 160. When the control shaft 160 rotates, the pulsator 140 is moved up and down.

Figure 4:
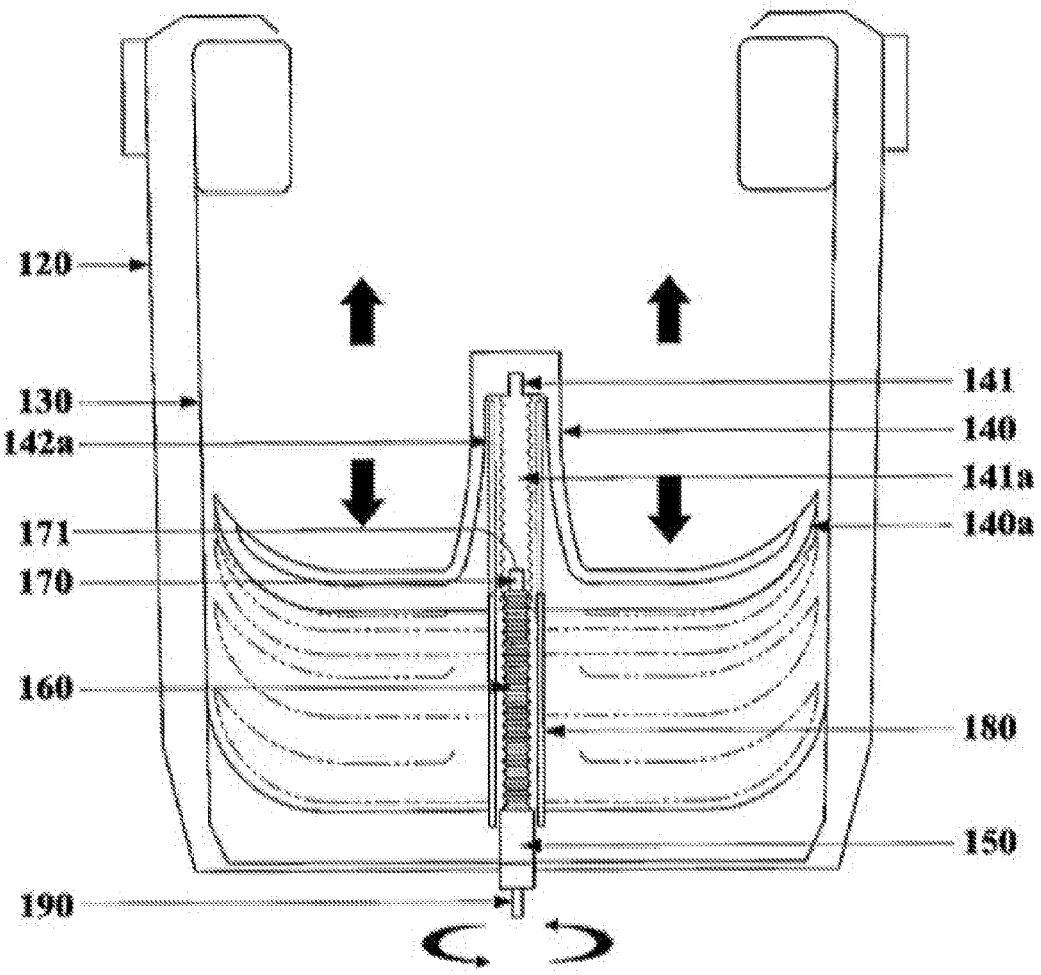
FIG. 4 is a configuration diagram of the fully automatic washing machine having a laundry lifting device according to exemplary embodiments of the present disclosure when the laundry is unloaded.

As illustrated in FIGS. 4 and 5, a guide U/D has a predetermined height, and is at the rotating central portion of the pulsator 140. The height of the guide U/D corresponds to a distance that the pulsator 140 ascends and descends.

A lower or bottom surface of the pulsator 140 has a support plate 140*a*, configured to support the pulsator 140 as it moves up and down. The support plate 140*a* connects to the bottom surface of the pulsator 140, but is not firmly attached to the lower or bottom surface of the pulsator 140, and thus may be configured to rotate the pulsator 140. The lower or bottom surface of the pulsator 140 and the support plate 140*a* may have a planar or flat surface in a center portion and a curved surface (e.g., a concave upwards surface) in a peripheral portion.

The support plate 140*a* is separate from the pulsator 140 to prevent the support plate 140*a* from idling, to secure the support plate 140*a* by the ball screw configuration when the pulsator 140 moves up and down, and to allow the pulsator 140 to rotate during the washing process.

A central portion of the support plate 140*a* has a screw hole 141*a* in a vertical direction. The screw hole 141*a* is along the same shaft line or axis as the rotating central point of the pulsator 140.

The washing tub shaft 150 is under the guide U/D, and the control shaft 160 is threaded through (e.g., screw-connected to) the screw hole 141*a* of the support plate 140*a* through a hollow portion of the washing tub shaft 150. The pulsator shaft 170 is connected to the pulsator 140 through a hollow portion of the control shaft 160.

Therefore, the washing tub shaft 150, the control shaft 160, and the pulsator shaft 170 are directly connected along the same axis or line, and each shaft is supplied with power from the motor by the clutch assembly 190 having the 3-shift clutch structure as described above. As a result, the 3-shift clutch structure allows the pulsator 140 to lift the laundry upward to be unloaded.

When the clutch assembly 190 regulates and/or rotates the washing tub shaft 150, the washing tub 130 rotates to perform the spin-drying process. Alternatively, when the clutch assembly 190 regulates the rotation of the pulsator shaft 170, the pulsator 140 rotates to perform the washing process.

When the clutch assembly 190 regulates and/or rotates the control shaft 160, the control shaft 160 rotates and the support plate 140*a* remains stationary, allowing the support plate 140*a* and the pulsator 140 thereon to move up and down.

According to embodiments of the present disclosure, the inner portion of the guide U/D has an insertion space, and the central portion of the support plate 140*a* has a protrusion with a predetermined height to be inserted in the insertion space of the guide U/D.

The screw hole 141*a* is at or in the protrusion of the support plate 140*a* at a predetermined height, such that the control shaft 160 having the screw thread on the outer circumferential surface thereof is threaded through (e.g., screwed and/or connected to) the support plate 140*a*.

The support plate 140*a* is in, on, or under the lower portion of the pulsator 140, and thus, the support plate 140*a* and the pulsator 140 are firmly held when the pulsator 140 moves upward for unloading the laundry after the washing is finished.

An upper end of the guide U/D may have a coupling hole 141 (e.g., tooth-shaped, serrated, or gear-like) on the same axis or shaft line with the screw hole 141*a* of the support plate 140*a*. For example, an upper end of the pulsator shaft 170 may have a coupling gear 171 that fits in the coupling hole 141.

The coupling hole 141 and the coupling gear 171 may be connected to each other or may be disconnected from each other when the pulsator 140 moves up and down and the pulsator shaft 170 remains stationary. When the pulsator 140 descends, the coupling hole 141 of the pulsator 140 engages, meshes with or fits in the coupling gear 171 of the pulsator shaft. When the pulsator 140 ascends, the coupling hole 141 and the coupling gear 171 disconnect from each other.

When the pulsator 140 ascends to unload the laundry, the pulsator 140 does not rotate, and the coupling hole 141 and the coupling gear 171 detach from each other. When the pulsator 140 descends to wash the laundry, the power of the motor is transferred by meshing or engaging the pulsator shaft 170 with the pulsator 140.

Alternatively, the pulsator shaft 170 may have an upper portion connected to the pulsator 140 and a lower portion connected to the clutch assembly, but still be disconnected from the pulsator 140. When the pulsator 140 ascends, the upper portion of the pulsator shaft 170 is disconnected from the pulsator 140. When the pulsator 140 descends, the pulsator 140 remains connected to the lower portion of the pulsator shaft. However, such a structure may complicate the apparatus and cause frequent failure.

In some embodiments of the present disclosure, at least one fixing hole 142*a* having a predetermined height is around the screw hole 141*a* of the support plate 140*a*. Each fixing hole 142*a* may fit or mate with the fixing rod 180 to prevent the support plate 140*a* from idling.

For example, the fixing rod 180 has one end fixed or attached to the clutch assembly 190 as a support part and another end inserted into the fixing hole 142*a* of the support plate 140*a*. The fixing rod 180 may also be fixed or attached to one or more other parts, such as the lower or bottom surface of the washing tub 130 in addition to the clutch assembly 190.

The pulsator 140 is provided with the screw hole 141*a* and is screwed onto and/or connected with the control shaft 160, thereby moving the pulsator 140 upward and downward. However, when the control shaft 160 and the pulsator 140 rotate at the same time, the ball screw action may not be secured and the control shaft 160 may be idling.

When the pulsator 140 is connected to the fixing rod 180, the pulsator 140 may be fixed and does not rotate. However, the pulsator 140 needs to rotate during the washing process. Therefore, the fixing rod 180 may not fit in or be attached to the pulsator 140 to prevent the pulsator 140 from idling.

According to embodiments of the present disclosure, the support plate 140*a* that supports the pulsator 140 may be provided with the fixing hole 142*a* having a predetermined height, and is configured to be attached to or fitted with the fixing rod 180.

The support plate 140*a* may preferably have a shape that covers the overall lower or bottom surface of the washing tub 130 to move all the laundry upward.

Therefore, a gap between the support plate 140*a* and the washing tub 130 is sealed to prevent the laundry from being dislodged or caught therebetween, and thus, preventing the laundry from being damaged and preventing the failure of the washing machine. However, there is a space or gap at the bottom of the pulsator 140 to allow the screw mechanism to raise the control shaft 160.

The outer ends of the support plate 140*a* and the pulsator 140 may have a shape that bends upward, so that the laundry may be collected at or in the central portion.

The support plate 140*a* may be bent or curve upward and the pulsator 140 disposed thereon may have an outer edge that bends or curves upward.

When the washing cycle is finished, the pulsator 140 may rotate to the left and right alternatingly a number of times (e.g., about 2 to 3 times, and generally, at a relatively low speed and/or by a full rotation or less), thereby by collecting the laundry in the central portion of the pulsator 140. As a result, the laundry may be easily arranged and unloaded.

Hereinafter, an operation of the fully automatic washing machine having a laundry lifting device according to embodiments of the present disclosure having the above configuration will be described.

First, the door 111 on the upper portion of the body 110 is opened when the laundry is loaded into the washing tub 130. After the laundry is loaded, the washing cycle is set and/or begun by pressing an operation button.

Next, when the door 111 is closed and the washing starts, the water is supplied to the water storage tank 120 along with the detergent and the washing starts.

The washing process comprises rotating the pulsator 140 in which the clutch assembly 190 connects the pulsator shaft 170 to the motor. Furthermore, the coupling gear 171 of the upper end of the pulsator shaft 170 is fitted into or meshed with the coupling hole 141 inside the upper end of the pulsator 140 when the pulsator 140 descends.

Therefore, the power of the motor is transferred to the pulsator shaft 170, and the pulsator shaft 170 rotates the pulsator 140 to generate water streams for washing the laundry. Since the support plate 140*a* is held stationary by the fixing rod 180, only the pulsator 140 rotates.

When the washing is finished and the spin-drying is performed, a valve in, under, or adjacent to the drainage hole in the water storage tank 120 is opened to drain the washing water. Furthermore, the clutch assembly 190 connects the washing tub shaft 150 to the motor.

The washing tub 130 rotates at a high speed to drain water through the spin-drying holes on or in the wall of the washing tub 130.

When the washing cycles are finished (e.g., completing the washing and spin-drying processes or cycles), the pulsator 140 rotates left and right alternatingly 2 to 3 times to collect the laundry in the center or flat portion of the pulsator 140. The pulsator 140 may have an outer edge that bends or curves upward, such that the laundry may be collected in the central portion.

The clutch assembly 190 connects the control shaft 160 to the motor to unload the laundry. The support plate 140*a* connected to the control shaft 160 (e.g., like the ball screw) ascends and the pulsator 140 supported thereon ascends.

The support plate 140*a* is fixed or attached by the fixing rod 180 to prevent the support plate 140*a* and the control shaft 160 from idling, thereby moving the pulsator 140 upward.

As a result, the user may easily and conveniently unload the laundry that is collected in the central portion of the pulsator 140 that has ascended to a predetermined height or by a predetermined distance.

It should be understood that the exemplary embodiments described above are not limiting, but only an example in all respects. The scope of the present disclosure is expressed by claims below, not the detailed description, and all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A washing machine having a laundry lifting device comprising:

a water storage tank in a body, configured to store washing water;

a washing tub in the water storage tank, configured to perform washing and/or spin-drying processes;

a pulsator at or over a lower or bottom surface of the washing tub, configured to generate one or more water streams;

a washing tub shaft connected to the washing tub, configured to rotate the washing tub;

a control shaft connected to the pulsator, configured to move the pulsator upward and downward;

a pulsator shaft connected to the pulsator, configured to rotate the pulsator; and a clutch assembly configured to transfer power from a motor to the washing tub shaft, the control shaft, and the pulsator shaft, wherein the pulsator shaft is connected to the pulsator through a hollow portion of the control shaft, and is configured to move the pulsator and a support plate upward and downward and wherein the support plate remains stationary when the control shaft rotates.

2. The washing machine of claim 1, wherein the pulsator comprises a rotating central portion.

3. The washing machine of claim 2, wherein the rotating central portion of the pulsator has a guide with a predetermined height.

4. The washing machine of claim 3, wherein the washing tub shaft is below the guide.

5. The washing machine of claim 3, wherein the guide of the pulsator comprises an inner portion having an insertion space.

6. The washing machine of claim 5, wherein the central portion of the support plate comprises a protrusion having a predetermined height in the insertion space of the guide.

7. The washing machine of claim 1, further comprising a support plate at, on or below a lowermost or bottom surface of the pulsator, the support plate configured to support the pulsator as the pulsator moves upward and downward.

8. The washing machine of claim 7, wherein the support plate comprises a central portion with a screw hole in a vertical direction.

9. The washing machine of claim 8, wherein the control shaft is threaded through the screw hole of the support plate through a hollow portion of the washing tub shaft.

10. The washing machine of claim 8, wherein the guide of the pulsator comprises an upper end having a coupling hole on a same line or axis as the screw hole.

11. The washing machine of claim 10, wherein the pulsator shaft comprises an upper end having a coupling gear that is configured to mesh with or fit in the coupling hole.

12. The washing machine of claim 11, further comprising:

a fixing hole having a predetermined height around the screw hole of the support plate; and a fixing rod having one end fixed or attached to a support part and another end in the fixing hole of the support plate to prevent the support plate from idling when the pulsator moves upward and/or downward.

13. The washing machine of claim 7, wherein the support plate has a shape that covers the lowermost or bottom surface of the washing tub and moves the laundry upward.

14. The washing machine of claim 7, wherein the support plate and the pulsator have outer ends bent or curved upward to collect laundry at a central portion of the pulsator.

15. The washing machine of claim 1, wherein the control shaft is configured to move the pulsator downward during the washing and/or the spin-drying process.

16. The washing machine of claim 1, wherein the control shaft is configured to move the pulsator upward when the washing process is finished.

17. The fully automatic washing machine of claim 1, wherein the clutch assembly comprises a 3-shift clutch assembly.

18. The washing machine of claim 1, wherein the clutch assembly is configured to regulate and/or rotate the washing tub shaft during the spin-drying process, and regulate the rotation of the pulsator shaft during the washing process.

* * * * *